US006715656B1

(12) United States Patent
Stanard

(10) Patent No.: US 6,715,656 B1
(45) Date of Patent: Apr. 6, 2004

(54) STAPLING DEVICE

(76) Inventor: Patricia P. Stanard, 101 Rainbow Fish Cir., Jupiter, FL (US) 33477

( * ) Notice: Subject to any disclaimer, the term of this patent is extended or adjusted under 35 U.S.C. 154(b) by 0 days.

(21) Appl. No.: 10/340,960

(22) Filed: Jan. 13, 2003

(51) Int. Cl.[7] ..... B25C 5/11

(52) U.S. Cl. ..... 227/110; 227/111; 227/154; 227/156

(58) Field of Search ..... 227/15, 19, 17, 227/24, 27, 109, 110, 111, 119, 142–144, 154, 156, 120; 412/6, 28, 33, 38

(56) References Cited

U.S. PATENT DOCUMENTS 172,848 A 10/1953 Tauber
2,694,807 A * 11/1954 Shlesinger, Jr. ..... 227/110
2,716,749 A 9/1955 Timmerbeil
2,776,431 A * 1/1957 Strong ..... 227/120
3,016,538 A * 1/1962 Oussani ..... 227/110
3,101,478 A 8/1963 Oussani
4,640,451 A * 2/1987 Steiner et al. ..... 227/76
5,626,275 A 5/1997 Chen
5,806,749 A * 9/1998 Chen ..... 227/131

* cited by examiner

*Primary Examiner*—Stephen F. Gerrity
*Assistant Examiner*—Thanh Truong

(57) ABSTRACT

A stapling device for positioning a plurality of staples in a paper along a line includes a base having a top side, a bottom side and a pair of opposed side edges. A plurality of parallel and elongated slots is positioned in the top side and each extends through the front and back edges. A mounting includes a first rod and a plurality of second rods. The second rods each extend in the same direction and are spaced from each other. Each of the second rods has a shape and positioning for slidably extending into one of the slots such that a slot remains empty between each of the slots has one of the second rods therein. Each one of a plurality of staplers is mounted on one of the second rods and extends toward a free end of the second rods.

8 Claims, 2 Drawing Sheets

STAPLING DEVICE

BACKGROUND OF THE INVENTION

1. Field of the Invention

The present invention relates to staplers and more particularly pertains to a new stapler for securing together a stack of papers uniformly along one side.

2. Description of the Prior Art

The use of staplers is known in the prior art. U.S. Pat. No. 5,626,275 describes a twin stapler device that has a base, a platform on the base, a cover connected to the platform and two staplers disposed between the platform and the cover. Another type of stapler is U.S. Pat. No. 3,101,478 describes a multiple fastener device and punch driving apparatus. U.S. Pat. No. Des. 172,848 describes an ornamental design for a stapling machine. U.S. Pat. No. 2,716,749 describes stapling machine for simultaneously inserting at least two staples.

While these devices fulfill their respective, particular objectives and requirements, the need remains for a device that can align and staple the edges of documents together in one motion and which is adjustable for documents varying in size.

SUMMARY OF THE INVENTION

The present invention meets the needs presented above by incorporating a removable, adjustable base and supporting paper guides for allowing a user to simultaneously place multiple staples in various sizes of documents.

Another object of the present invention is to provide a new stapler that would eliminate the need to press three staples separately into the stack of papers, thus saving time and effort. It would also ensure that the staples are aligned in a straight line.

Still another object of the present invention is to provide a new stapler that would be fast and easy to use and could increase productivity in the workplace or in the home.

To this end, the present invention generally comprises a base having a top side, a bottom side and a peripheral edge. The peripheral edge includes a front edge, a back edge, and a pair of side edges. A plurality of elongated slots is positioned in the top side and each extends along a length of the top side and through the front and back edges. The slots are orientated generally parallel to each other. A mounting includes a first rod and a plurality of second rods that are attached to the first rod at a perpendicular orientated with respect to the first rod. The second rods extend in the same direction and are spaced from each other. Each of the second rods has a shape and positioning for slidably extending into one of the slots such that a slot remains empty between each of the slots has one of the second rods therein. Each one of a plurality of staplers is mounted on one of the second rods and extends toward a free end of the second rods.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty, which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
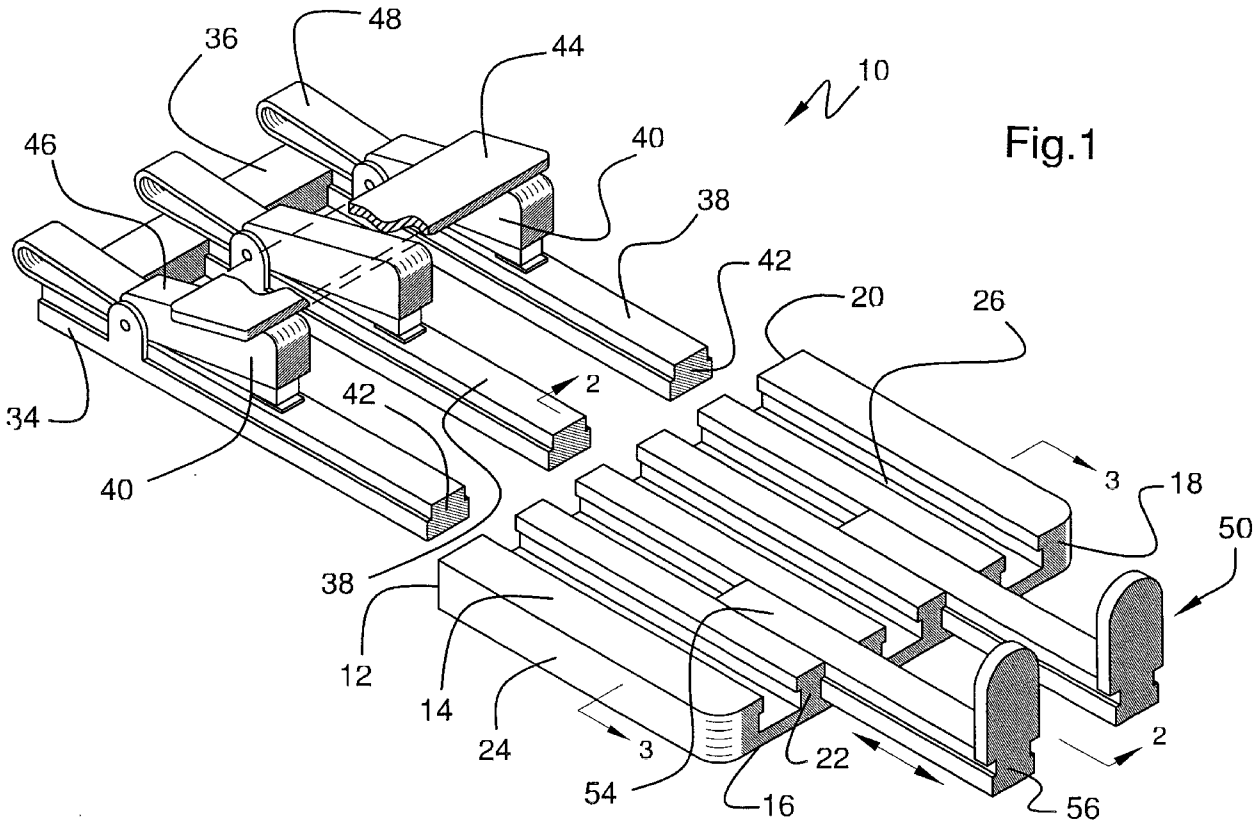
FIG. 1 is a perspective view of a stapling device according to the present invention.
Figure 2:
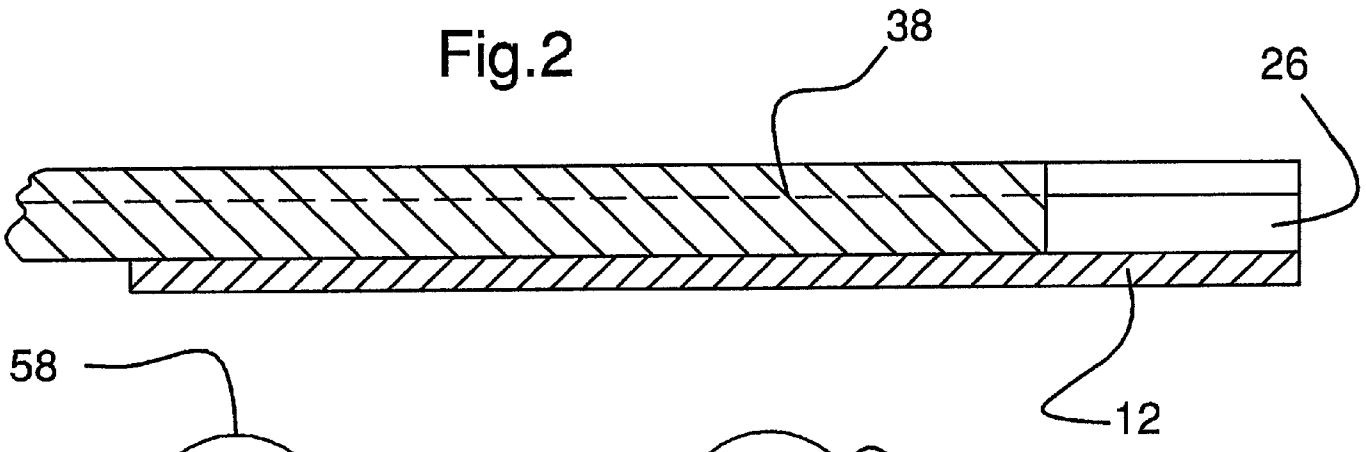
FIG. 2 is a cross-sectional view taken along the line 2—2 of FIG. 1 of the present invention.
Figure 3:
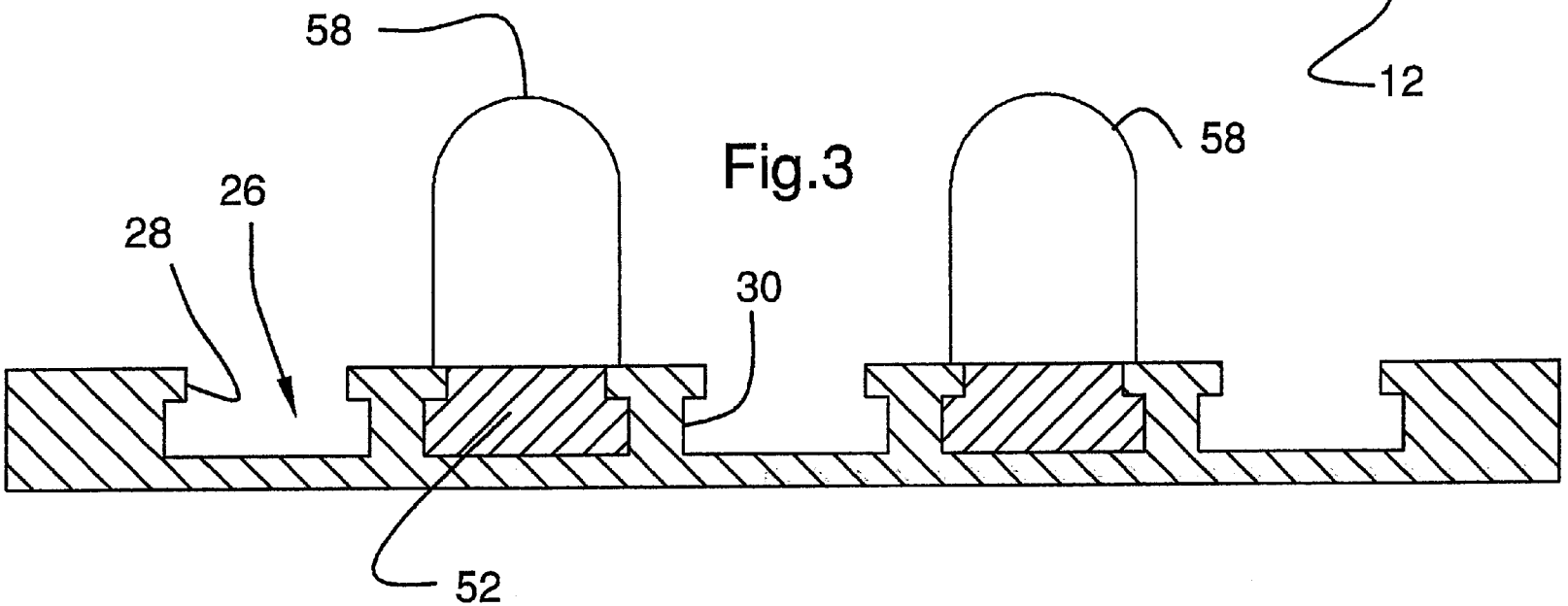
FIG. 3 is a cross-sectional view taken along the line 3—3 of FIG. 1 of the present invention.

With reference now to the drawings, and in particular to FIGS. 1 through 3 thereof, a new stapler embodying the principles and concepts of the present invention and generally designated by the reference numeral 10 will be described.

As best illustrated in FIGS. 1 through 3, a stapling device 10 generally comprises a base 12 having a top side 14, a bottom side 16 and a peripheral edge 18. The peripheral edge 18 includes a front edge 20, a back edge 22, and a pair of side edges 24. A plurality of elongated slots 26 is positioned in the top side 14. Each of the slots 26 extends along a length of the top side 14 and through the front 20 and back 22 edges. The slots 26 are orientated generally parallel to each other. The plurality of slots 26 preferably comprises five slots 26. Each of the slots 26 has an upper portion 28 adjacent to the top side 14 and a lower portion 30. The lower portions 30 have a width greater than the upper portions 28.

A mounting 34 includes a first rod 36 and a plurality of second rods 38 attached to the first rod 36 at a perpendicular orientated with respect to the first rod 36. The second rods 38 extend in the same direction and are spaced from each other. Each of the second rods 38 has a shape and positioning for slidably extending into one of the slots 26 such that a slot 26 remains empty between each of the slots 26 having one of the second rods 38 therein. The plurality of second rods 38 is preferably three second rods 38.

Each one of a plurality of staplers 40 is mounted on one of the second rods 38 and extends toward a free end 42 of the second rods 42. The staplers 40 are pivotally mounted on the second rods 38 so that paper may be positioned under the staplers 40. A push bar 44 is attached to and extends between a top side 46 of the staplers 40. Ideally, a plurality of biasing members 48 biases the staplers 40 in an upward position spaced from the second rods 38. The staplers 40 are conventional staplers 40 not having a bottom portion.

A plurality of paper guides 50 is used for positioning of paper on the base 12. Each of the paper guides 50 includes an elongated member 52 having a first end 54 and a second end 56. Each of the elongated members 52 has a shape adapted for slidably positioning in one of the slots 26. Each one of a plurality of feet 58 is attached to one of the second ends 56. The feet 58 extend above a plane of the top side 14 when the elongated members 52 are positioned in the slots 26.

In use, paper is positioned on the base 23 such that it abuts the feet 58. The mounting 34 is positioned so that the paper is located beneath the staplers 40 in the desired position. The user then presses down on the push bar 44 to extend a plurality of staples into the paper along its edge. The ability to move the feet 58 and the mounting 34 allows for different sized paper to be stapled in an efficient manner.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stapler device for simultaneously stapling a plurality of staples into a paper stock, said device comprising:

a base having a top side, a bottom side and a peripheral edge, said peripheral edge including a front edge, a back edge, and a pair of side edges, a plurality of elongated slots being positioned in said top side, each of said slots extending along a length of said top side and through said front and back edges, said slots being orientated parallel to each other;

a mounting including a first rod and a plurality of second rods being attached to said first rod at a perpendicular orientated with respect to said first rod, said second rods extending in the same direction and being spaced from each other, each of said second rods having a shape and positioning for slidably extending into one of said slots such that a slot remains empty between each of said slots having one of said second rods therein; and a plurality of staplers, each of said staplers being mounted on one of said second rods and extending toward a free end of said second rods.

2. The stapler device as in claim 1, wherein said plurality of slots comprises five slots.

3. The stapler device as in claim 1, wherein each of said slots has an upper portion adjacent to said top side and a lower portion, said lower portions having a width greater than said upper portions.

4. The stapler device as in claim 1, wherein said plurality of second rods being three second rods.

5. The stapler device as in claim 1, further including a push bar being attached to and extending between a top side of said staplers.

6. The stapler device as in claim 5, further including a plurality of paper guides, each of said paper guides including an elongated member having a first end and a second end, each of said elongated members having a shape adapted for slidably positioning in one of said slots, a plurality of feet, each of said feet being attached to one of said second ends, each of said feet extending above a plane of said top side when said elongated members are positioned in said slots.

7. The stapler device as in claim 1, further including a plurality of paper guides, each of said paper guides including an elongated member having a first end and a second end, each of said elongated members having a shape adapted for slidably positioning in one of said slots, a plurality of feet, each of said feet being attached to one of said second ends, each of said feet extending above a plane of said top side when said elongated members are positioned in said slots.

8. A stapler device for simultaneously stapling a plurality of staples into a paper stock, said device comprising:

a base having a top side, a bottom side and a peripheral edge, said peripheral edge including a front edge, a back edge, and a pair of side edges, a plurality of elongated slots being positioned in said top side, each of said slots extending along a length of said top side and through said front and back edges, said slots being orientated parallel to each other, said plurality of slots comprising five slots, each of said slots having an upper portion adjacent to said top side and a lower portion, said lower portions having a width greater than said upper portions;

a mounting including a first rod and a plurality of second rods being attached to said first rod at a perpendicular orientated with respect to said first rod, said second rods extending in the same direction and being spaced from each other, each of said second rods having a shape and positioning for slidably extending into one of said slots such that a slot remains empty between each of said slots having one of said second rods therein, said plurality of second rods being three second rods;

a plurality of staplers, each of said staplers being mounted on one of said second rods and extending toward a free end of said second rods, a push bar being attached to and extending between a top side of said staplers; and a plurality of paper guides, each of said paper guides including an elongated member having a first end and a second end, each of said elongated members having a shape adapted for slidably positioning in one of said slots, a plurality of feet, each of said feet being attached to one of said second ends, each of said feet extending above a plane of said top side when said elongated members are positioned in said slots.

* * * * *